US006631786B1

(12) United States Patent
Gunacker

(10) Patent No.: US 6,631,786 B1
(45) Date of Patent: Oct. 14, 2003

(54) PROCESS AND DEVICE FOR THE LUBRICATION OF A RAILROAD TRACK WITH VIGNOLE-TYPE RAILS

(76) Inventor: Richard Gunacker, Hauptstrasse 21, A-3013 Tullnerbach, Oesterreich (AT)

( * ) Notice: Subject to any disclaimer, the term of this patent is extended or adjusted under 35 U.S.C. 154(b) by 0 days.

(21) Appl. No.: 09/617,164

(22) Filed: Jul. 17, 2000

(30) Foreign Application Priority Data

Jul. 21, 1999 (AT) ..... 1269/99

(51) Int. Cl.[7] ..... B61K 3/00
(52) U.S. Cl. ..... 184/3.1
(58) Field of Search ..... 184/3.1, 3.2

(56) References Cited

U.S. PATENT DOCUMENTS 1,301,816 A 4/1919 Busbyl
2,104,176 A * 1/1938 Warr ..... 184/3
3,163,257 A * 12/1964 McWilliams ..... 184/3
3,599,752 A * 8/1971 Bowler ..... 184/3
4,520,901 A * 6/1985 Borup et al. ..... 184/3.1
5,076,396 A * 12/1991 Foote ..... 184/3.1
5,236,063 A 8/1993 Nelson et al.
5,394,958 A * 3/1995 Junk et al. ..... 184/3.1
5,503,536 A * 4/1996 Waldenstrom et al. ..... 417/229
5,641,037 A 6/1997 Wise et al.
5,842,543 A * 12/1998 Naito et al. ..... 184/3.1

FOREIGN PATENT DOCUMENTS

CH 672 101 10/1989

* cited by examiner

*Primary Examiner*—David Fenstermacher
(74) *Attorney, Agent, or Firm*—Reed Smith, LLP

(57) ABSTRACT

A method for the lubrication of Vignole type railroad track, especially preceding a curved portion which is subject to wear by the wheel flanges of railroad cars, by applying lubricant essentially horizontally against the inner side of the Vignole type railroad track by an application device supplied with lubricant, wherein the lubricant is applied to the track through the movement of the application device along the track to be lubricated.

24 Claims, 12 Drawing Sheets

PROCESS AND DEVICE FOR THE LUBRICATION OF A RAILROAD TRACK WITH VIGNOLE-TYPE RAILS

BACKGROUND OF THE INVENTION a) Field of the Invention

The invention is directed to a method for the lubrication of Vignole type railroad track, especially preceding a curved portion which is subject to wear by the wheel flanges of railroad cars, by applying lubricant essentially horizontally against the inner side of the Vignole type railroad track by means of an application device supplied with lubricant.

b) Description of the Related Art

In a method of the above type, it is known to apply the lubricant by means of a stationary application device, that is, only in spots. Accordingly, an excessive amount of grease is applied to one location or a number of locations and is then spun off by the wheels of the moving train. Apart from the high consumption of grease, this carries the risk that grease will attain the running surface and impair braking action.

OBJECT AND SUMMARY OF THE INVENTION

In order to remedy this, one object of the invention proposes to apply the lubricant to the track through the movement of the application device along the track to be lubricated. In this way, a uniform film of grease is achieved on the side surface of the rail head. The length of this grease film should be approximately equal to the circumference of a wheel. The grease film contributes to a 30-percent reduction in wear on material compared to known lubricating methods, thereby increasing the life of the rails and also that of the wheel flanges of the wheels. When using the method according to the invention, the grease is applied in a deliberate manner, so that the critical height at the rail which should not be exceeded is maintained and defect-free braking action can be achieved. When curves are to be lubricated, application of the lubricant is preferably carried out before the curve, ideally at the last straight stretch of track before the curve. The wheels then transfer the lubricant to the curved track.

A device is suggested for carrying out the method according to the invention. This device has a nozzle head to which the lubricant is supplied and is characterized in that the nozzle head which is provided with nozzle carriers that are preferably spaced with respect to one another is fastened to a holder which can be moved along the track by a stationary drive which is preferably fastened to a rail of the track. The movement of the application device is realized in a simple manner by means of this embodiment form.

In a further construction of the device according to the invention, the drive for the nozzle head can be a piston-cylinder unit which is preferably double-acting, wherein the holder of the nozzle head is formed as a bar or rod which preferably penetrates the cylinder of the piston-cylinder unit and is connected with the piston of the piston-cylinder unit. A reliable drive is achieved by means of the piston-cylinder unit in the described embodiment form. The frost-resistant design poses no problem in this respect.

For supplying lubricant, the nozzle carriers are advantageously connected with one another by a pipe to which the lubricant can preferably be supplied in the center between the nozzle carriers. In this embodiment form, the pipe also contributes to the mutual support and spacing of the nozzle carriers. When the nozzle carriers are at a greater distance from one another, it is advisable to support the pipe relative to the (stationary) cylinder. The support, which must permit a relative movement between the pipe and the cylinder, is advantageously carried out by a carriage whose wheels run in guides connected with the cylinder of the piston-cylinder unit.

The desired film height can be achieved by using wide-slit nozzles in the nozzle carriers and by adjusting the device or by means of bristles, in particular, made of steel wire, which are anchored in the base of the nozzle carrier and to which lubricant can be supplied through openings in the nozzle base. After application, the bristles must be moved away laterally from the rail head.

If the device for lubricating is to be fastened to the rail, this is carried out without damaging the rail profile or rail section when the drive for the nozzle head is fastened to the rail base or rail foot via clamps, wherein one clamp embraces the rail foot from below and the other clamp rests on top of the rail foot and when the two clamps are arranged so as to be movable relative to one another, e.g., in that the clamp embracing the rail foot from the bottom is provided with a thread which penetrates a bore hole of the clamp resting on top of the rail foot, wherein a nut which is supported at the clamp resting on top of the rail foot can be screwed onto the thread. For this purpose, in a further development of the invention, one of the clamps, preferably the clamp resting on top of the rail foot, can be provided with a carrying pin for fixing the drive of the device relative to the rail, wherein the cylinder of the piston-cylinder unit is preferably outfitted with a retaining plate having openings which are constructed in particular as an elongated hole and which can be penetrated by the carrying pin, wherein the retaining plate can be clamped, as the case may be, at different distances from the rail at the carrying pin between two screw nuts.

In a further development of the invention, the drive for the nozzle head can be fastened to the sleepers or ties. Particularly in the case of wooden ties, it is advantageous when a preferably angular base plate is fastened, particularly by means of wood screws, to the upper side of the ties, wherein a fastening plate projects from the base plate and is provided with through-openings, especially elongated holes which extend at an inclination to the plane of the base plate and which are penetrated by retaining pins to which the drive for the nozzle head is fastened, preferably, the retaining plate with which the cylinder of the piston-cylinder unit is outfitted. In this embodiment form, a base plate and a fastening plate connected with the latter are required for the fastening of the nozzle head drive. The fastening of the base plate to the tie can also be carried out without weakening the tie by applying bore holes or the like when a fastening angle which is fastened to the base plate by one of its legs, especially so as to be adjustable, is supported by its second leg at a side wall of the tie, especially by means of two screw bolts, and when the angle of the base plate contacts the opposite side wall, so that the tie is grasped by the angle and the fastening angle in the manner of a vice. The fastening of the retaining device for the nozzle head drive is carried out in this arrangement by clamping the retaining device to the tie, which could also be made of wood.

The invention will be explained more fully in the following with reference to device examples which are shown in the drawings and which are suitable for carrying out the method according to the invention.

BRIEF DESCRIPTION OF THE INVENTION

FIGS. 8 and 9 show a detail from FIG. 7, wherein FIG. 8 is a side view and FIG. 9 is a top view.

FIGS. 11 and 12 show a detail from FIG. 10, wherein FIG. 11 is a side view and FIG. 12 shows a section along line XII—XII, in FIG. 11.

FIGS. 13 and 14 show another detail from the view in FIG. 10, wherein FIG. 13 is a side view and FIG. 14 is a cross section; FIG. 16 shows a section along line XVI—XVI in FIG. 15.

DESCRIPTION OF THE PREFERRED EMBODIMENTS

Figure 1:
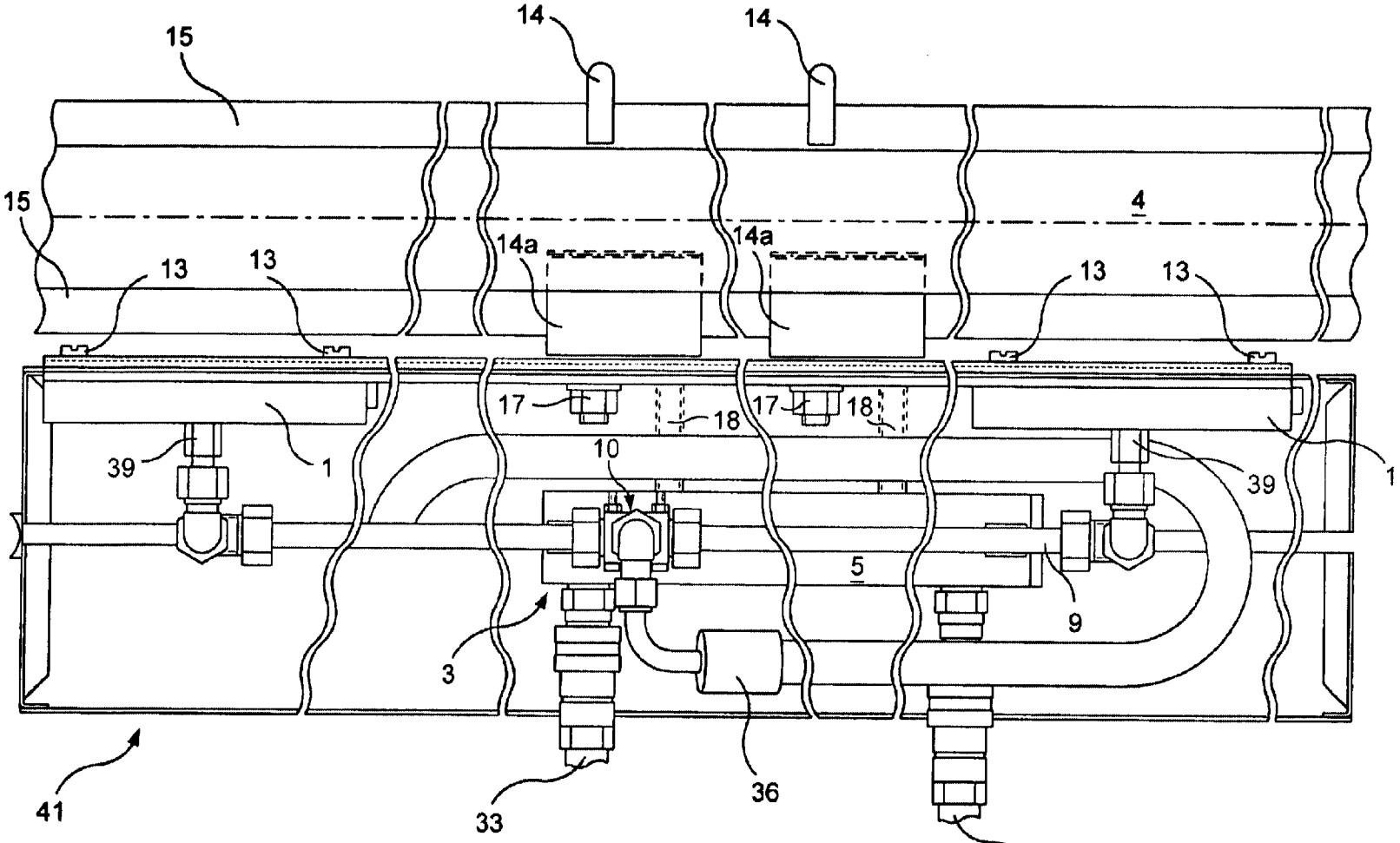
FIG. 1 shows a top view of a device suitable for carrying out the method according to the invention which is mounted on a rail.
Figure 2:
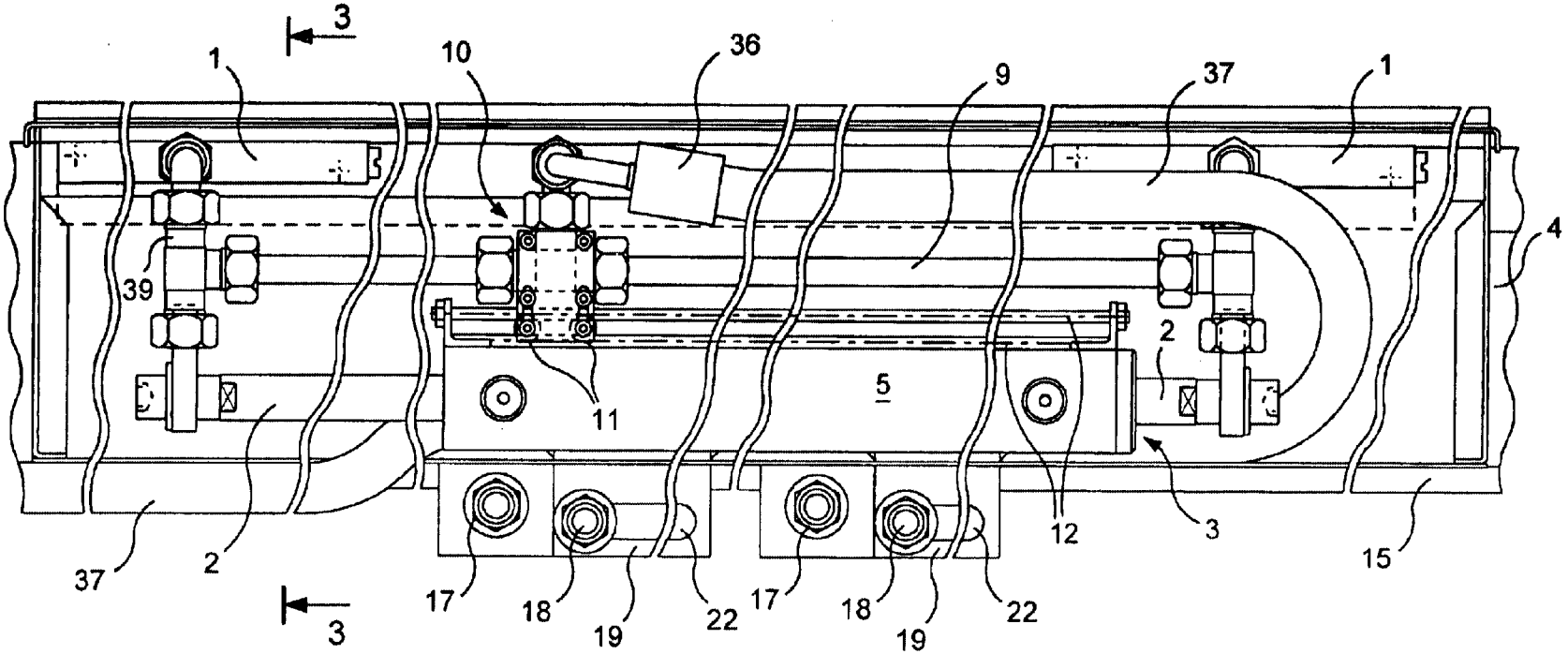
FIG. 2 shows the device according to FIG. 1 in a front view.
Figure 3:
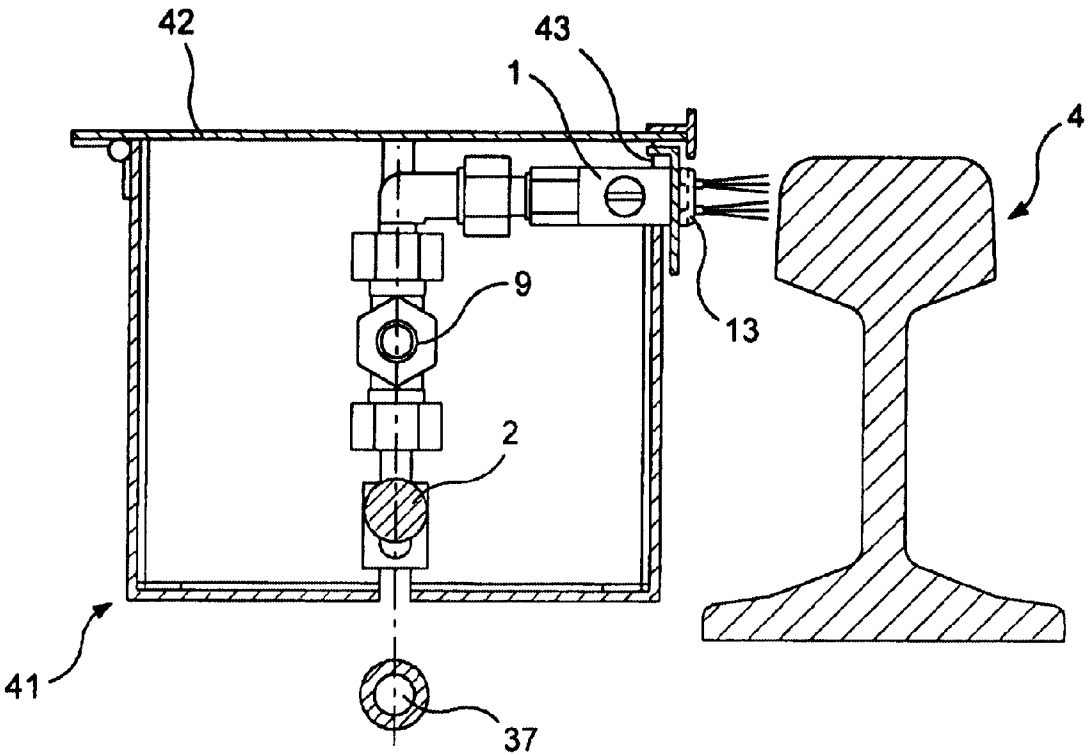
FIG. 3 shows a section along line III—III in FIG. 2.
Figure 4:
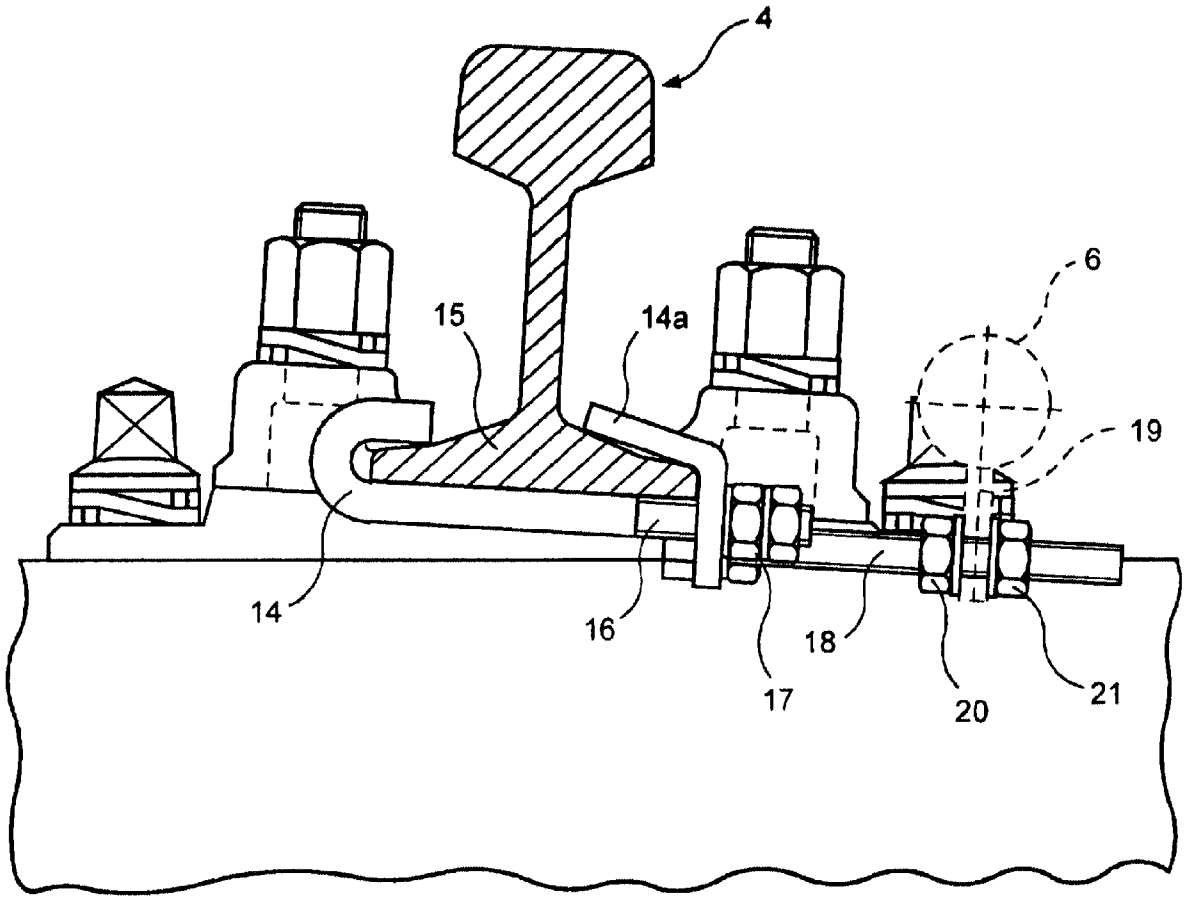
FIG. 4 is a view in cross section showing an embodiment form in which the device according to the invention is fastened to the base or foot of a rail.
Figure 5:
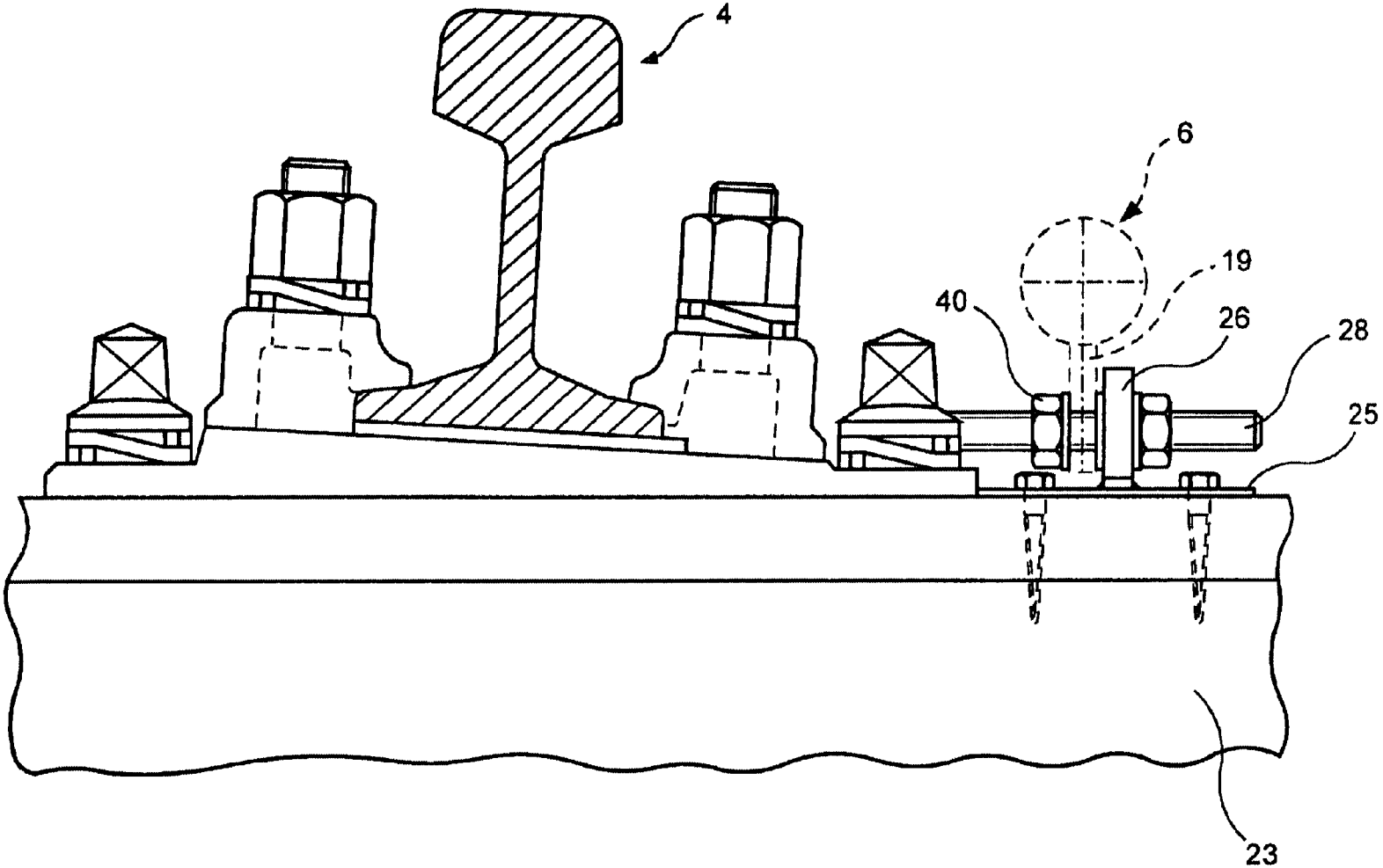
FIG. 5 shows a view corresponding to FIG. 4 in which the device according to the invention is fastened to a wooden ties
Figure 6:
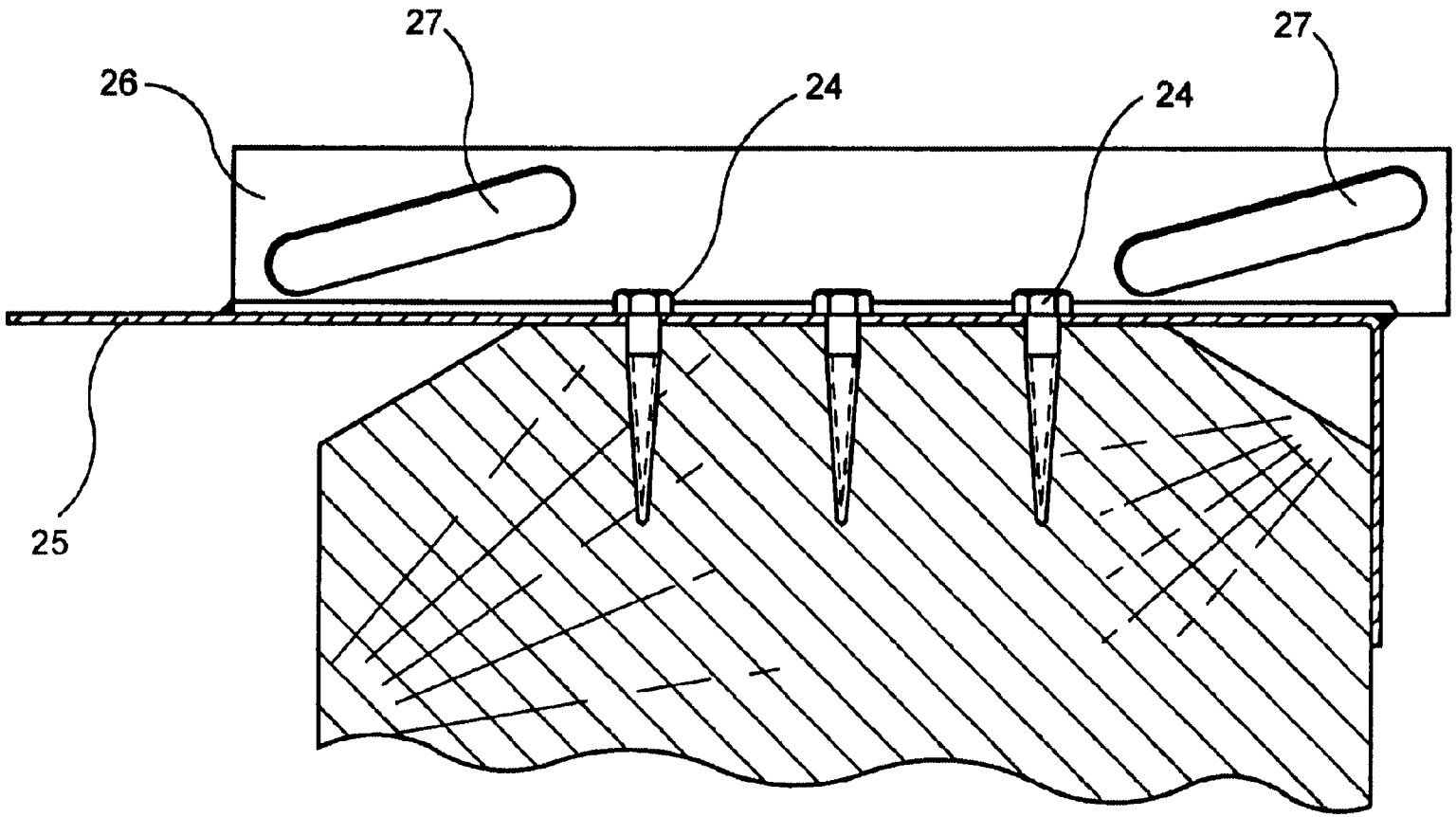
FIG. 6 shows a detail from FIG. 5.
Figure 12:
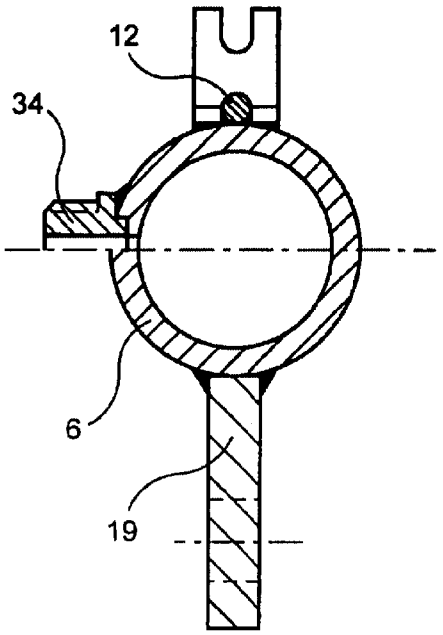
Figure 11:
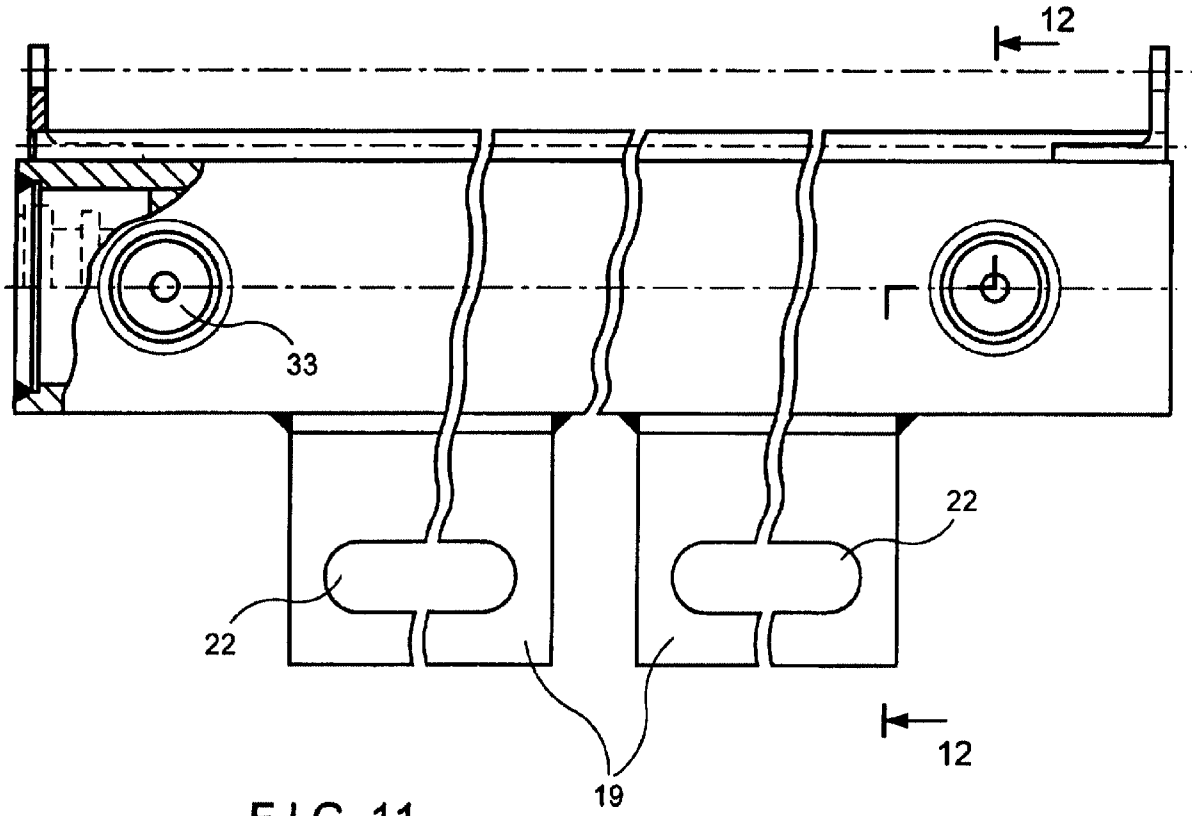

In FIGS. 1 and 2 of the drawing, dividing lines are drawn in by means of pairs of dash-dot lines extending parallel to one another because the length of the device could not be shown in its entirety for reasons of space. The rail of a Vignole type railroad track to be lubricated is designated by 4 in the drawing. The lubricant is dispensed on the inner side at the head of the rail 4 via nozzles 13. Two nozzles 13 are arranged in each nozzle carrier 1. In the embodiment example, a nozzle head is outfitted with two such nozzle carriers 1. The nozzle head is fastened to a holder 2 which is movable along the track via a stationary drive 3. The drive 3 can be fastened to the rail 4 as is shown in the embodiment examples in FIGS. 1, 2 and 4. However, it is also possible to fasten the drive 3 for the nozzle head to ties as is shown in FIGS. 5 and 6 for a wooden tie and in FIGS. 7 to 9 for a concrete tie. The drive 3 for the nozzle head is constructed as a double-acting piston-cylinder unit 5 in the embodiment example. The holder 2 of the nozzle head can be constructed as a rod 7 penetrating the cylinder 6 of the piston-cylinder unit 5. In the embodiment example (FIG. 10), the rod 7 is divided, i.e., it does not penetrate the piston, but rather is screwed into the piston by one end. When the rod 7 penetrates the piston 8, it must likewise be fixedly connected therewith. The fuel or propelling agent is supplied to the cylinder 6 of the piston-cylinder unit 5 via two lines 33, 34 which open into cylinder spaces which are separated from one another by the piston. The cylinder 6 of the piston-cylinder unit 5 can be seen in greater detail in FIG. 12. The nozzle carriers 1 are connected with one another by a pipe 9 to which the lubricant can be supplied, preferably centrally between the carriers 1. If the spacing between the nozzle carriers 1 is large, it is advisable to support the pipe relative to the cylinder 6. In this connection, it is advisable when a carriage 10 whose wheels 11 run in guides 12 connected with the cylinder 6 of the piston-cylinder unit 5 is provided for supporting the pipe.

Figure 14:
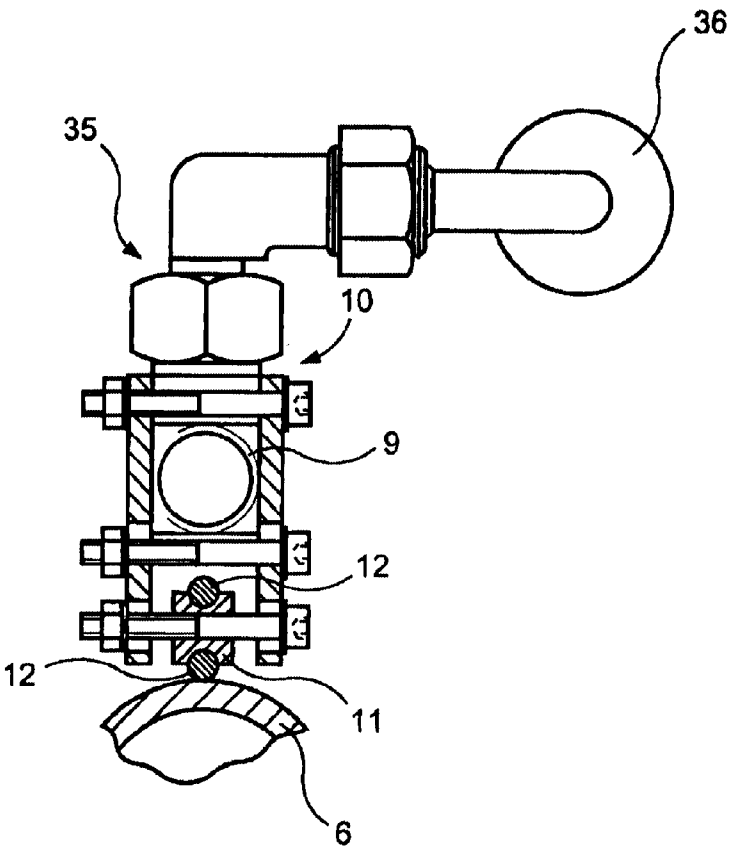
Figure 13:
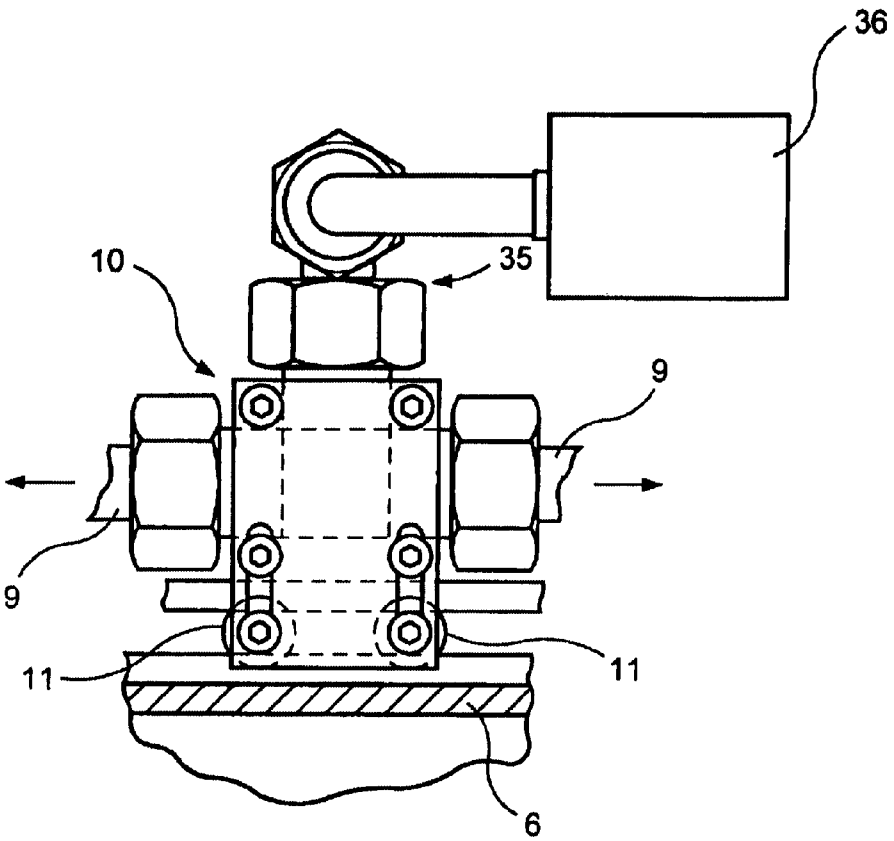

This embodiment form is shown in detail in FIGS. 13 and 14. The feed of the lubricant into the pipe 9 is carried out via a feed connection 35 which is connected via a connection piece 36 with a hose line 37 which is fed in turn from the lubricant reservoir. The hose line 37 is made of a flexible material because it must follow the movement of the connection piece 35 along the cylinder 6 of the piston-cylinder unit 5.

Figure 15:
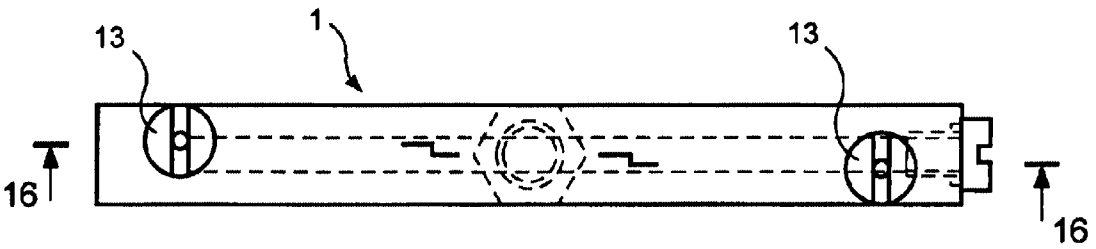
FIGS. 15 and 16 show another detail from FIG. 10, wherein the view in FIG. 15 is a side view
Figure 16:
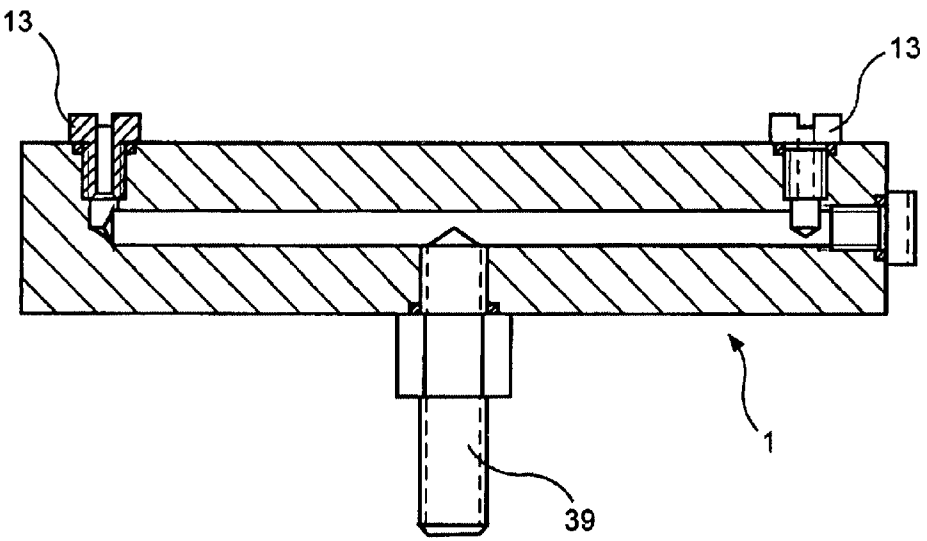

As is illustrated in particular in FIG. 15, the nozzle carriers 1 are outfitted with wide-slit nozzles 13. Two such nozzles which are arranged at the ends of the nozzle carrier 1 and situated in the symmetrically in the center with respect to the center of the nozzle carrier 1 are shown in the embodiment example. The nozzles 13 are screwed into the nozzle carrier 1. The channels of the wide-slit nozzles 13 are connected with one another via a bore hole 38 in the nozzle carrier 1. The lubricant is supplied through this bore hole centrally via a connection 39. In an embodiment form which is not shown, the supply of the lubricant to the head of the rails 4 can also be carried out by bristles which are preferably made of steel wire and are anchored in the nozzle carrier 1. The lubricant is fed to the bristles in the area of their anchoring via openings in the nozzle carrier.

When the drive for the nozzle head is fastened to the rail foot, it is advisable to use clamps 14, 14*a* for this purpose so as not to weaken the rails by means of bore holes or the like. One clamp 14 can grasp the rail foot 15 from the bottom, while the other clamp 14*a* rests on top of the rail foot 15 as is shown in detail in FIG. 4. The two clamps 14, 14*a* are arranged so as to be movable relative to one another. For this purpose, the clamp 14 which grasps the rail foot 15 from the bottom can be provided with a thread 16 which penetrates a bore hole of the clamp 14*a* resting on top of the rail foot 15, wherein a nut 17 can be screwed onto the thread 16 and supported at the clamp 14*a* resting on top of the rail foot 15. One of the clamps 14, 14*a* is provided with a carrying pin 18 for fixing the drive 3 of the device relative to the rail 4. The fastening is preferably carried out in that the cylinder 6 of the piston-cylinder unit 5 is outfitted with a retaining plate 19 which can be penetrated by carrying pins 18, especially openings constructed as an elongated hole 22, wherein the retaining plate 19 can be clamped between two screw nuts 20, 21 at the carrying pin 18 at different distances from the rail 4. The construction of the opening in the retaining plate 19 as an elongated hole 22 allows an adjustment of the lubricating device relative to the rail 4. When the elongated hole is formed at an inclination, the device can be adjusted by height as well as in the direction of the rails.

Figure 7:
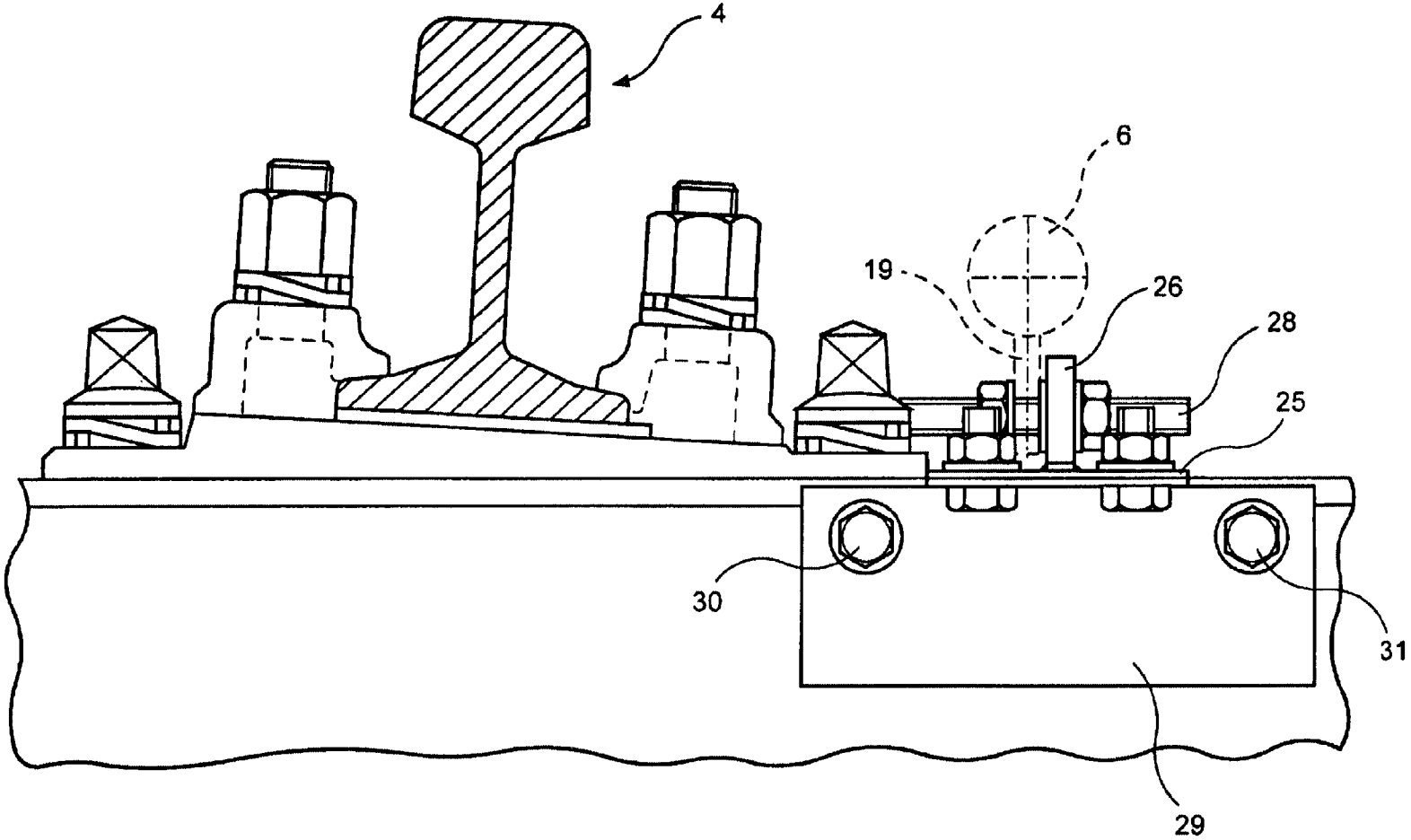
FIG. 7 shows an embodiment form in which the lubricating device according to the invention is fastened to a concrete tie.
Figure 8:
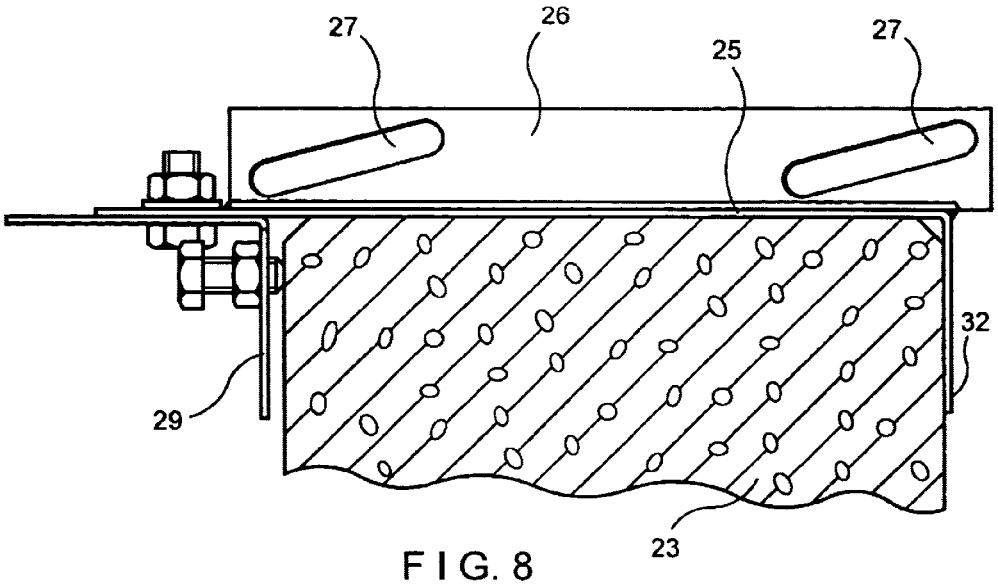
Figure 9:
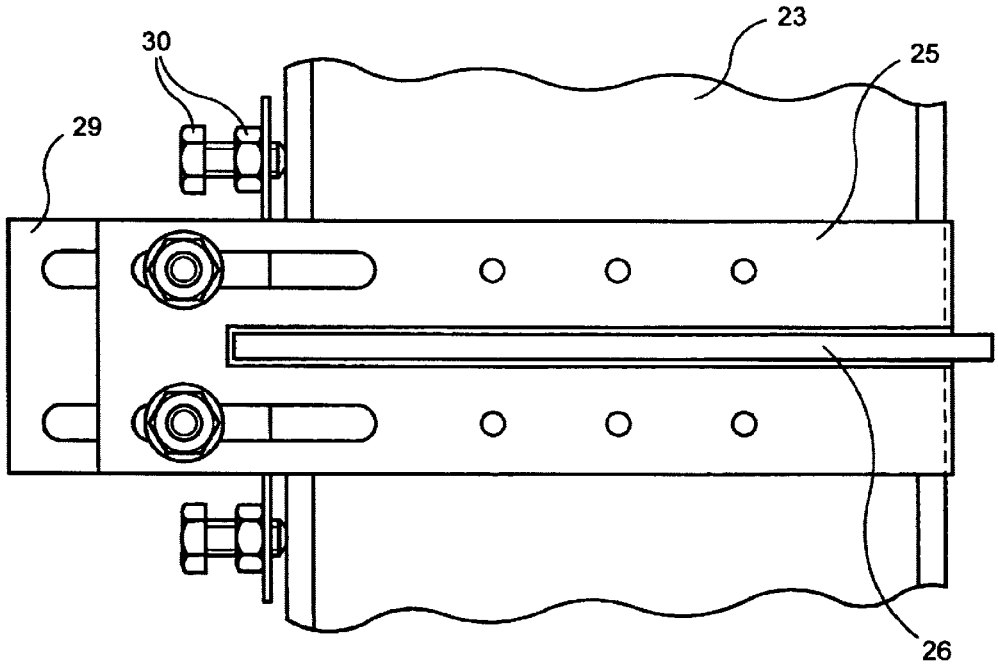
Figure 10:
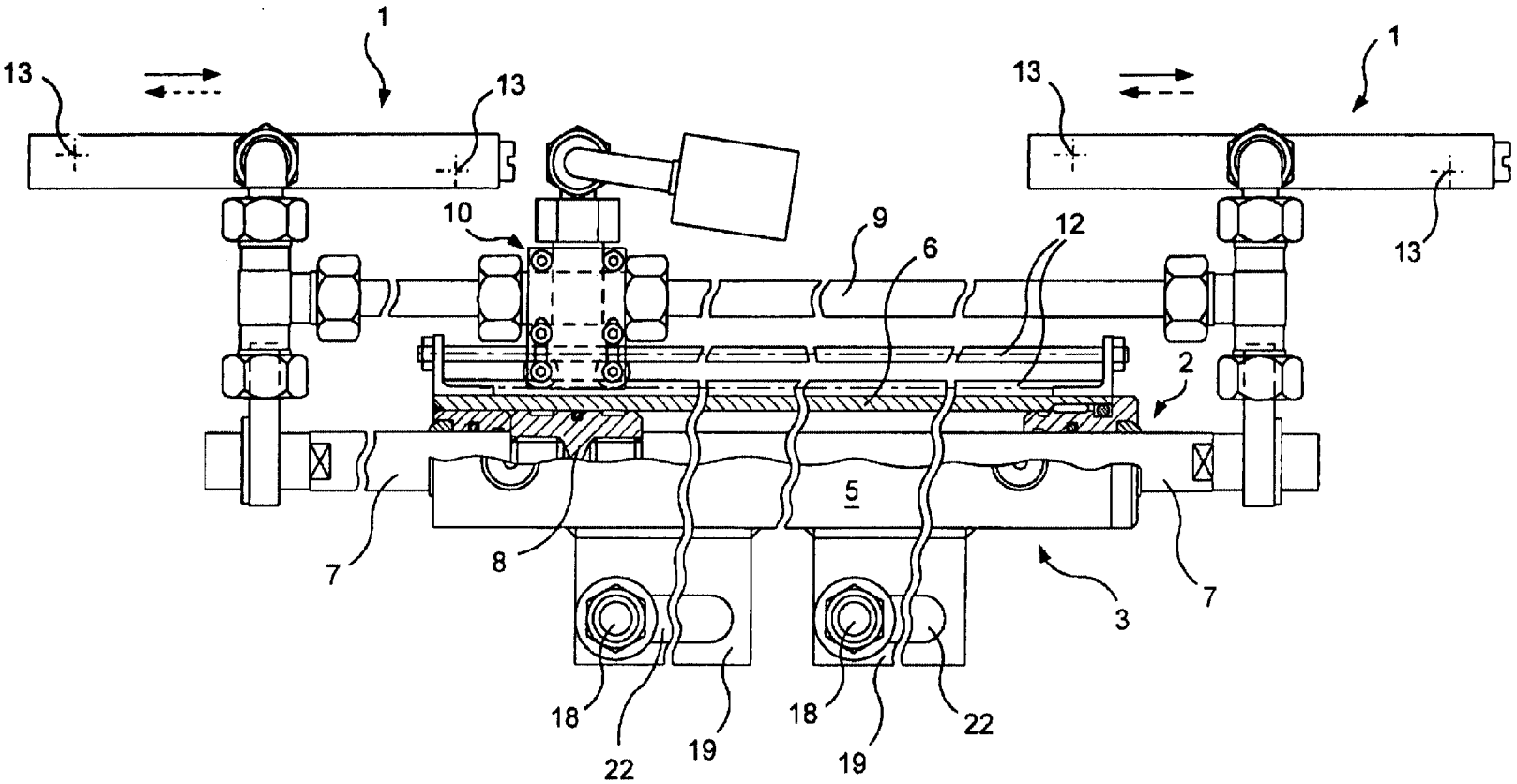
FIG. 10 is a detailed view of the lubricating device shown in FIG. 1.

The drive for the nozzle head can also be fastened to the ties 23 as is shown in FIGS. 5 to 9. FIGS. 5 and 6 shows the fastening to wooden ties, whereas FIGS. 7 to 9 show a fastening of the lubricating device to concrete ties. In principle, however, it is also possible to use the fastening devices of FIGS. 5 and 6 in a concrete tie and, conversely, the fastening device in FIGS. 7 to 9 can also be carried out with wooden ties.

According to FIGS. 5 and 6, an angular base plate 25 is fastened to the top of the ties 23 by means of screws 24. A fastening plate 26 which is provided with through-openings 27 which preferably extend at an inclination to the plane of the base plate projects from the base plate 25. The through-openings 27 are formed as elongated holes. The through-openings 27 are penetrated by retaining pins 28 to which the drive for the nozzle head is fastened. The retaining plate 19 with which the cylinder 6 of the piston-cylinder unit 5 is outfitted is advisably used for fastening. The retaining plates 19 of the cylinder 6 are clamped between the fastening plate 26 and a screw nut 40. The elongated holes 22 in the retaining plates 19 can extend with their longitudinal axis parallel to the axis of the cylinder 6.

In the embodiment form in FIGS. 7 to 9, a fastening angle 29 is secured to the base plate 25 by one of its legs so as to be adjustable. As is shown particularly in FIGS. 8 and 9, one leg of the fastening angle 29 is provided with two slits arranged parallel to one another and at a distance from one another for adjusting the fastening angle 29. In a corresponding manner, the base plate 25 also has two slits extending parallel to one another. The slits in the base plate and in the leg of the fastening angle 29 are penetrated by screws and can be clamped against one another in the desired relative position by means of these screws. The second leg of the fastening angle 29 is supported at a side wall of the tie 23. The support is carried out in the embodiment example by means of two screw bolts 30, 31 which contact the side wall of the tie 23 by their end faces and project through bore holes in the leg of the fastening angle 29. The angle 32 of the base plate 25 contacts the side wall of the tie 23 located opposite to the side wall at which the fastening angle 29 is supported. In this way, the tie 23 is grasped by the angle 32 and the fastening angle 29 in the manner of a vice.

The lubricating device is arranged in a stationary housing 41 which is provided with a swivel lid 42 and which has, at its side surface facing the rail 4, a slit or other recess 43 extending parallel to the track, through which the nozzle carrier 1 projects by its nozzles 13. In FIGS. 1 and 2, there is a distance between the housing lid 42 and the outer side wall of the housing 41 for purposes of clarity.

while the foregoing description and drawings represent the present invention, it will be obvious to those skilled in the art that various changes may be made therein without departing from the true spirit and scope of the present invention.

What is claimed is:

1. A device with a nozzle head to which the lubricant is fed, wherein the nozzle head is provided with nozzle carriers that are spaced with respect to one another and which are fastened to a holder which can be moved along the track by a stationary drive which is fastened to a rail of the track to apply lubricant essentially horizontally against an inner side of the Vignole type railroad track by the application device supplied with lubricant, the lubricant being applied to the track through movement of the application device along the track to be lubricated.

2. The device according to claim 1, wherein the drive for the nozzle head is a double-acting piston-cylinder unit, wherein the holder of the nozzle head is formed as a rod which penetrates the cylinder of the double-acting piston-cylinder unit and is connected with the piston of the double-acting piston-cylinder unit.

3. The device according to claim l, wherein the nozzle carriers are connected with one another by a pipe to which the lubricant can be supplied in the center between the nozzle carriers, and wherein the pipe is supported relative to the cylinder.

4. The device according to claim 3, wherein the pipe is supported relative to the cylinder by a carriage whose wheels run in guides connected with the cylinder of the piston-cylinder unit.

5. The device according to claim 1, wherein the nozzle carriers are outfitted with wide-slit nozzles which are anchored in the base of the nozzle carrier and to which lubricant can be supplied through openings in the nozzle base.

6. The device according to claim 1, wherein the drive for the nozzle head is fastened to the rail foot via clamps, wherein one clamp embraces the rail foot from the bottom and the other clamp rests on top of the rail foot, and wherein the two clamps are arranged so as to be movable relative to one another, wherein the clamp embracing the rail foot from the bottom is provided with a thread which penetrates a bore hole of the clamp resting on top of the rail foot, wherein a nut which is supported at the clamp resting on top of the rail foot can be screwed onto the thread.

7. The device according to claim 6, wherein one of the clamps, the clamp resting on top of the rail foot, is provided with a carrying pin for fixing the drive of the device relative to the rail, wherein the cylinder of the piston-cylinder unit is outfitted with a retaining plate having openings which are constructed as an elongated hole and which can be penetrated by the carrying pin, wherein the retaining plate can be clamped, as the case may be, at different distances from the rail at the carrying pin between two screw nuts.

8. The device according to claim 1, wherein the drive for the nozzle head is fastened to the ties.

9. The device according to claim 8, wherein in the case of ties made from wood, an angular base plate is fastened, by wood screws, to the upper side of the ties, wherein a fastening plate projects from the base plate and is provided with through-opening elongated holes which extend at an inclination to the plane of the base plate and which are penetrated by retaining pins to which the drive for the nozzle head is fastened, preferably, the retaining plate with which the cylinder of the piston-cylinder unit is outfitted.

10. The device of claim 9, wherein the fastening plate is the retaining plate with which the cylinder of the piston cylinder unit is outfitted.

11. The device according to claim 8, wherein in the case of concrete ties, a fastening angle which is fastened to the base plate by one of its legs, especially so as to be adjustable, is supported by its second leg at a side wall of the tie, especially by two screw bolts, and wherein the angle of the base plate contacts the opposite side wall, so that the tie is grasped by the angle and the fastening angle in the manner of a vice.

12. The device according to claim 1, wherein the nozzle carriers are outfitted with bristles made of steel wire which are anchored in the base of the nozzle carrier and to which lubricant can be supplied through openings in the nozzle base.

13. A method for the lubrication of Vignole type railroad track, comprising the steps of:

providing an application device with at least one nozzle head to which the lubricant is fed, wherein the nozzle head is provided with nozzle carries that are space with respect to one another and are fastened to a holder which is moved along the track by a stationary drive which is fastened to the rail of the track;

applying lubricant essentially horizontally against an inner side of the Vignole type railroad track by the application device supplied with lubricant, the lubricant being applied to the track through movement of the application device along the track to be lubricated.

14. The method according to claim 13, wherein the drive for the nozzle head is a double-acting piston-cylinder unit, wherein the holder of the nozzle head is formed as a rod which penetrates the cylinder of the double-acting piston-cylinder unit and is connected with the piston of the double-acting piston-cylinder unit.

15. The method according to claim 13, wherein the nozzle carriers are connected with one another by a pipe to which the lubricant can be supplied in the center between the nozzle carriers, and wherein the pipe is supported relative to the cylinder.

16. The method according to claim 15, wherein the pipe is supported relative to the cylinder by a carriage whose wheels run in guides connected with the cylinder of the piston-cylinder unit.

17. The method according to claim 13, wherein the nozzle carriers are outfitted with wide-slit nozzles which are anchored in the base of the nozzle carrier and to which lubricant can be supplied through openings in the nozzle base.

18. The method according to claim 13, wherein the drive for the nozzle head is fastened to the rail foot via clamps, wherein one clamp embraces the rail foot from the bottom and the other clamp rests on top of the rail foot, and wherein the two clamps are arranged so as to be movable relative to one another, wherein the clamp embracing the rail foot from the bottom is provided with a thread which penetrates a bore hole of the clamp resting on top of the rail foot, wherein a nut which is supported at the clamp resting on top of the rail foot can be screwed onto the thread.

19. The method according to claim 18, wherein one of the clamps, the clamp resting on top of the rail foot, is provided with a carrying pin for fixing the drive of the device relative to the rail, wherein the cylinder of the piston-cylinder unit is outfitted with a retaining plate having openings which are constructed as an elongated hole and which can be penetrated by the carrying pin, wherein the retaining plate can be clamped, as the case may be, at different distances from the rail at the carrying pin between two screw nuts.

20. The method according to claim 13, wherein the drive for the nozzle head is fastened to the ties.

21. The method according to claim 20, wherein in the case of concrete ties, a fastening angle which is fastened to the base plate by one of its legs, especially so as to be adjustable, is supported by its second leg at a side wall of the tie, especially by two screw bolts, and wherein the angle of the base plate contacts the opposite side wall, so that the tie is grasped by the angle and the fastening angle in the manner of a vice.

22. The method according to claim 20, wherein in the case of ties made from wood, an angular base plate is fastened, by wood screws, to the upper side of the ties, wherein a fastening plate projects from the base plate and is provided with through-opening elongated holes which extend at an inclination to the plane of the base plate and which are penetrated by retaining pins to which the drive for the nozzle head is fastened, preferably, the retaining plate with which the cylinder of the piston-cylinder unit is outfitted.

23. The method of claim 22, wherein the fastening plate is the retaining plate with which the cylinder of the piston cylinder unit is outfitted.

24. The method according to claim 13, wherein the nozzle carriers are outfitted with bristles made of steel wire which are anchored in the base of the nozzle carrier and to which lubricant can be supplied through openings in the nozzle base.

* * * * *